US009854859B2

(12) United States Patent
McEwen

(10) Patent No.: US 9,854,859 B2
(45) Date of Patent: Jan. 2, 2018

(54) ENHANCED VISIBILITY GLOVE

(71) Applicant: PNP Concepts Pty Ltd, North Mackay (AU)

(72) Inventor: Peter McEwen, Glenden (AU)

(73) Assignee: PNP Concepts Pty Ltd, North Mackay (AU)

( * ) Notice: Subject to any disclaimer, the term of this patent is extended or adjusted under 35 U.S.C. 154(b) by 0 days.

(21) Appl. No.: 14/906,071

(22) PCT Filed: Jul. 18, 2014

(86) PCT No.: PCT/AU2014/050138
§ 371 (c)(1),
(2) Date: Jan. 19, 2016

(87) PCT Pub. No.: WO2015/006835
PCT Pub. Date: Jan. 22, 2015

(65) Prior Publication Data

US 2016/0165978 A1 Jun. 16, 2016

(30) Foreign Application Priority Data

Jul. 19, 2013 (AU) ..... 2013902701

(51) Int. Cl.
*A41D 19/00* (2006.01)
*A41D 19/015* (2006.01)

(52) U.S. Cl.
CPC ..... *A41D 19/0157* (2013.01); *A41D 19/00* (2013.01)

(58) Field of Classification Search
CPC .. A41D 19/00; A41D 19/01547; A61B 19/04; A63B 71/148
USPC ..... 2/163, 161.8, 167, 161.1, 159, 161.3
See application file for complete search history.

(56) References Cited

U.S. PATENT DOCUMENTS

| | | | | |
|---|---|---|---|---|
| 1,630,730 | A | 5/1927 | Daughterty | |
| 2,092,574 | A * | 9/1937 | Eddy | A41D 19/0157 116/35 R |
| 2,432,928 | A * | 12/1947 | Palmquist | G02B 5/128 359/538 |
| 2,787,236 | A * | 4/1957 | Welch | A41D 19/0157 116/35 R |
| 5,467,484 | A * | 11/1995 | Drescher | A41D 19/01547 2/161.6 |
| 6,006,357 | A * | 12/1999 | Mead | A41D 19/0157 2/160 |
| 7,735,153 | B1 * | 6/2010 | Romiti | A41D 19/01558 2/161.6 |
| 2011/0107493 | A1 | 5/2011 | Watson et al. | |
| 2012/0159691 | A1 | 6/2012 | Phillippe et al. | |

FOREIGN PATENT DOCUMENTS

| | | |
|---|---|---|
| EP | 2 591 688 A1 | 5/2013 |
| JP | 2004-316050 A | 11/2004 |

OTHER PUBLICATIONS

International Search Report issued in corresponding application No. PCT/AU2014/050138 dated Sep. 15, 2014 (3 pages).
Written Opinion issued in corresponding application No. PCT/AU2014/050138 dated Sep. 15, 2014 (4 pages).

* cited by examiner

*Primary Examiner* — Tejash Patel
(74) *Attorney, Agent, or Firm* — Osha Liang LLP

(57) ABSTRACT

An enhanced visibility glove to increase safety and allows a user to signal others in low light conditions.

18 Claims, 3 Drawing Sheets

ENHANCED VISIBILITY GLOVE

TECHNICAL FIELD

The present invention relates to safety, signalling and low light equipment and particularly to a piece of clothing that increases safety and allows a user to signal others in low light conditions.

BACKGROUND ART

Gloves that are reflective or have reflective portions applied thereto are conventionally available.

Perhaps the closest gloves to those of the present invention are reflective traffic safety gloves. These gloves are typically "fingerless" with a reflective snip on each of the four phalange portions and the thumb portion. They also normally have a yellow reflective triangle on the posterior metacarpal portion and a red octagon on the anterior metacarpal portion. These gloves were originally developed for traffic control, and they have been adapted to include a yellow triangle on both the posterior and anterior metacarpal portion and also a version with no reflective portion on the anterior metacarpal portion.

Whilst well designed for their purpose, these traffic safety gloves include many reflective panels which due to the size of the gloves, can be difficult to distinguish from one another, particularly from a distance.

Also, the fact that these gloves were designed for use of the hands without a tool means that the provision of the reflective portion on the anterior surface of the metacarpal portion means that they are not well suited to being worn when gripping or similar actions are undertaken.

It will be clearly understood that, if a prior art publication is referred to herein, this reference does not constitute an admission that the publication forms part of the common general knowledge in the art in Australia or in any other country.

SUMMARY OF INVENTION

The present invention is directed to an enhanced visibility glove, which may at least partially overcome at least one of the abovementioned disadvantages or provide the consumer with a useful or commercial choice.

With the foregoing in view, the present invention in one form, resides broadly in an enhanced visibility glove including a) a cuff portion, b) a metacarpal portion extending from the cuff portion, c) a thumb portion extending from the metacarpal portion and d) at least two phalange portions extending from the metacarpal portion, each having an anterior surface and a posterior surface and e) an enhanced visibility portion on the thumb portion and at least one but no more than two of the at least two phalange portions extending over the length of the portions on the posterior surface but not the anterior surface.

The glove of the present invention can be used for a variety of purposes including increased safety, as a signalling device or simply worn such that the enhanced visibility allows a wearer to more easily identify the location of their fingers and thumb in lowlight conditions or allows a viewer to see another person's hands such as for example, when working with others in low light conditions.

The enhanced visibility of the present invention may be provided in any manner. For example, the strip provided may be reflective, luminous, phosphorescent, chemiluminescent, or photoluminescent. Some of these mechanisms of enhancing visibility are more preferred than others due to their ability to emit light for extended periods, albeit at relatively low levels.

The glove of the present invention may be manufactured from any material or combinations of materials. In particular, portions of the glove may be manufactured from different materials in order to provide preferred properties to different portions. For example, the cuff portion will normally be elasticised or resilient in order to hold the wrist of the wearer. The cuff portion may also be provided with a tightening strap.

The glove will typically include four distinct phalange portions and one thumb portion. However, a pair of phalange portions may be provided rather than four, for example, one phalange portion for the ring finger and little finger and one phalange portion for the index finger and middle finger.

The phalange portions and thumb portions can be part-length portions but preferably, will be full-length portions. It is also preferred that as full-length portions, the phalange and thumb portions will be closed at their tip ends.

Portions of the glove may be formed separately from one another and attached together. For example, the glove can be formed from one or more tranks, fourcehttes, may include quirks or not, and may include lining, or not. The configuration of the glove itself and its manufacture and design is less important than the provision of the enhanced visibility strips.

The glove of the present invention will include an enhanced visibility portion, typically a strip, on the thumb portion and at least one, but no more than two of the phalange portions. The enhanced visibility strip will preferably extend over the length of the thumb and at least one phalange portions on the posterior surface thereof but not the anterior surface. This will typically leave the palm and anterior surfaces of the phalange portions and thumb portions unobstructed by the enhanced visibility strips.

Any method of forming the enhanced visibility portion can be used. For example, the portion can be provided as an adhesive strip applied to glove, the strip can be material impregnated into the material forming the glove or alternatively applied as a surface layer to the glove.

It is preferred that the enhanced visibility strip be elongate. Although the enhanced visibility strip can be any shape, a substantially rectangular shape is preferred. Normally, the enhanced visibility strip on the at least one, but no more than two phalange portions will be provided on adjacent phalange portions and typically, on the index finger phalange portion and the middle finger phalange portion.

The enhanced visibility strip is typically sized such that the strips on adjacent phalange portions and the thumb portion can be distinguished clearly from one another at a distance of approximately 10 m.

The enhanced visibility strip will preferably extend laterally over a portion of the posterior surface of each phalange portion to which it is applied, but not over the sides of the phalange portion. Typically, the enhanced visibility strip will extend from at or adjacent the tip of the phalange portions to the metacarpal portion of the glove adjacent the phalange portion to which the strip is applied. Normally, the strip will extend partially over the metacarpal portion towards the cuff of the glove.

Preferably, the configuration and extent of the strip applied to the thumb portion is substantially the same as that applied to the or each phalange portion.

It is preferred that each enhanced visibility strip is distinct and discrete or separated over its length from other enhanced visibility strips applied to other phalange portions and/or the thumb portion.

It is preferred that the strips applied to the phalange portion terminate at a transverse edge which is substantially perpendicular to the main longitudinal axis of the strip.

It is preferred that the strip applied to the thumb portion terminates at an angle which is other than transverse or perpendicular to the main longitudinal axis of the strip.

The enhanced visibility strip may be shaped to correspond to a tip portion of a phalange portion and/or a thumb portion at an outer end thereof. For example, the outer end of the enhanced visibility strip may be arcuate.

The or each enhanced visibility strip may be coloured in a particular colour or may simply be "white". Different colours or combinations of colours can be used to indicate different situations or provide different signals. A single strip may be formed from different colours or combinations of colours or a glove may be provided with strips that are different colours or combinations of colours.

The or each enhanced visibility strip may be patterned or not. Different patterns, or combinations of patterns can be used to indicate different situations. A single strip may be formed having different patterns or combinations of patterns or a glove may be provided with strips that have different patterns or combinations of patterns.

Words or numbers or symbols may be applied to the or each enhanced visibility strip. For example, one of the strips may be provided with words such as "left" or "right" or alternatively, symbols such as one or more chevrons may be provided on one or more strips on a glove. Where chevrons are provided, typically more than one is provided and the chevrons are oriented from the base of the strip (at the cuff end) toward the tip of the phalange portion or thumb portion. Provision of chevrons in this way can be used to indicate direction. Where provided, different numbers of chevrons may be provided on different strips in order to allow a viewer to distinguish between the different strips.

Typically enhanced visibility gloves will be provided in pairs although it may be possible to have a pair of gloves in which one of the pair is an enhanced visibility glove and the other glove is not. Where a pair of enhanced visibility gloves is provided, appropriate identification means might be provided to allow identification of each of the gloves in the pair.

Preferably, each of the enhanced visibility strips is provided in a block appearance of uniform colour and reflectivity or luminescence. However, a gradient of increasing or decreasing colour, reflectivity and/or luminescence may be used as again, this may be used to indicate direction. Preferably, the gradient where provided, will increase from the root (at the cuff end) to the tip of the strip.

An alternative aspect of the present invention may lie in the method of use of the enhanced visibility glove as described above. Provision of a strip on at least one and no more than two phalange portions as well as the thumb portion and on one side only of these portions, will typically allow use of the glove for signalling because of the ability to discern the strips and the relative location of the thumb portion and the phalange portions.

The glove can therefore be provided for any signalling purpose and typically, a code of different signals using the glove would be developed for recognition in particular circumstances.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

Figure 1:
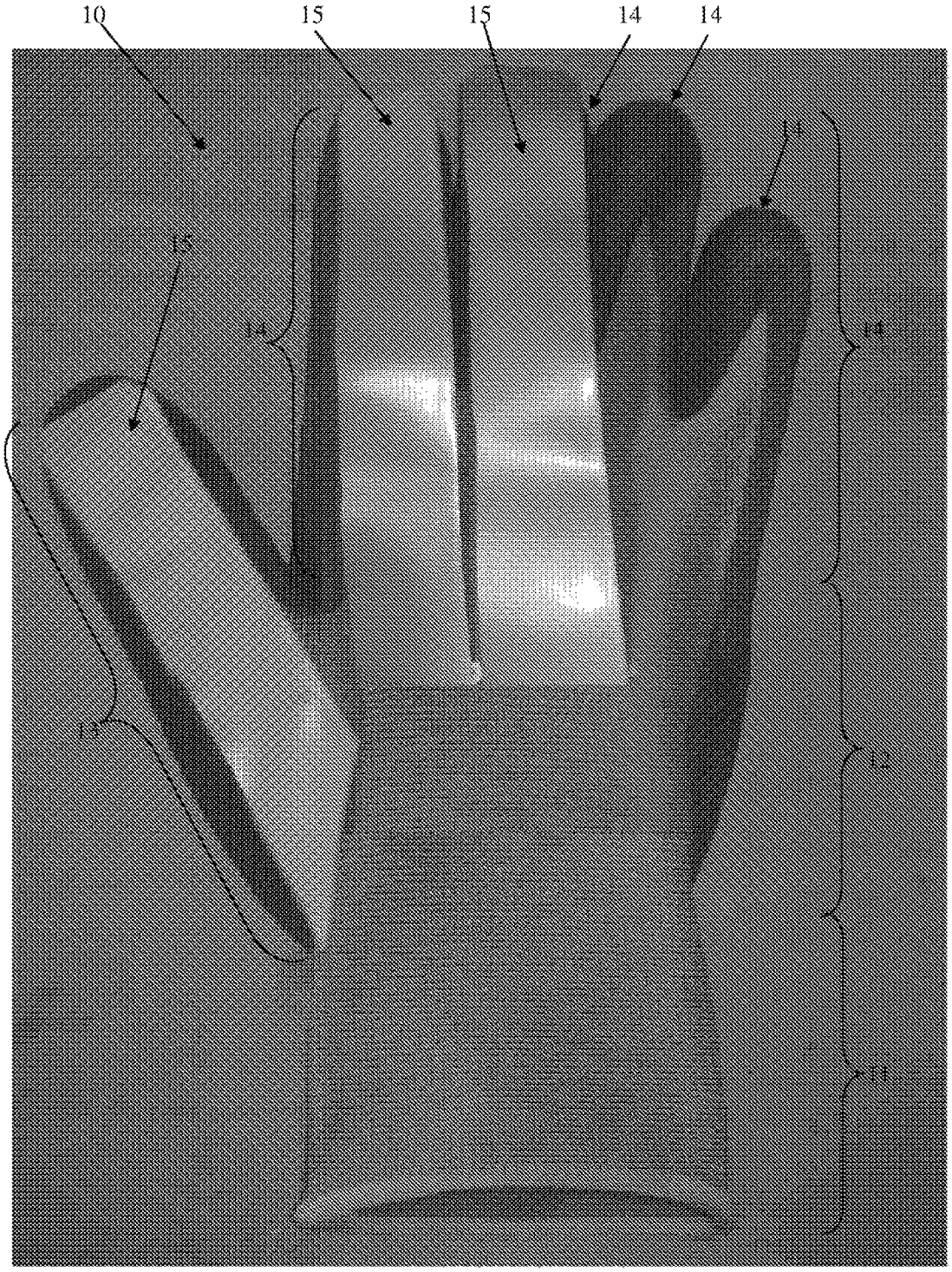
FIG. 1 is a plan view of an enhanced visibility glove according to a preferred embodiment of the present invention.

According to a particularly preferred embodiment of the present invention, an enhanced visibility glove 10 is provided.

The enhanced visibility glove 10 of the preferred embodiments illustrated in the Figures includes a cuff portion 11, a metacarpal portion 12, a thumb portion 13 and four phalange portions 14. Each has an anterior surface (palm side) and a posterior surface (opisthenar side) and an enhanced visibility strip 15 on the thumb portion 13 and two of the phalange portions 14 extending over the length of the portions on the posterior surface but not the anterior surface.

The glove of the illustrated embodiment is manufactured of a polymeric material. The cuff portion 11 is elasticised or resilient in order to hold the wrist of the wearer.

The phalange portions 14 and thumb portion 13 of the illustrated embodiment are full-length portions with enclosed tips.

The glove of the preferred embodiment includes an enhanced visibility strip 15 on the thumb portion 13 and two of the phalange portions 14. The enhanced visibility strip 15 extends over the length of the thumb portion 13 and the two phalange portions 14 on the posterior surface thereof but not the anterior surface. This will typically leave the palm and anterior surfaces of the phalange portions and thumb portions unobstructed by the enhanced visibility strips.

The strips 15 of the illustrated embodiment are provided as an adhesive strip applied to the glove.

Although the enhanced visibility strip can be any shape, a substantially rectangular shape is preferred. The enhanced visibility strip 15 on the two phalange portions is provided on adjacent phalange portions in the illustrated embodiment.

According to the preferred embodiment, the enhanced visibility strip 15 extend laterally over a portion of the posterior surface of each phalange portion 14 to which it is applied but not over the sides of the phalange portion 14. The enhanced visibility snip extends from adjacent the tip of the phalange portion 14 to the metacarpal portion 12 of the glove 10 adjacent the phalange portion 14 to which the strip is applied and partially over the metacarpal portion 12 towards the cuff of the glove.

The configuration and extent of the strip applied to the thumb portion is substantially the same as that applied to the two phalange portions.

As illustrated, the strips 15 applied to the phalange portion 14 terminate at a transverse edge which is substantially perpendicular to the main longitudinal axis of the strip and the strip 15 applied to the thumb portion 13 terminates at an angle which is other than transverse or perpendicular to the main longitudinal axis of the strip.

Figure 2:
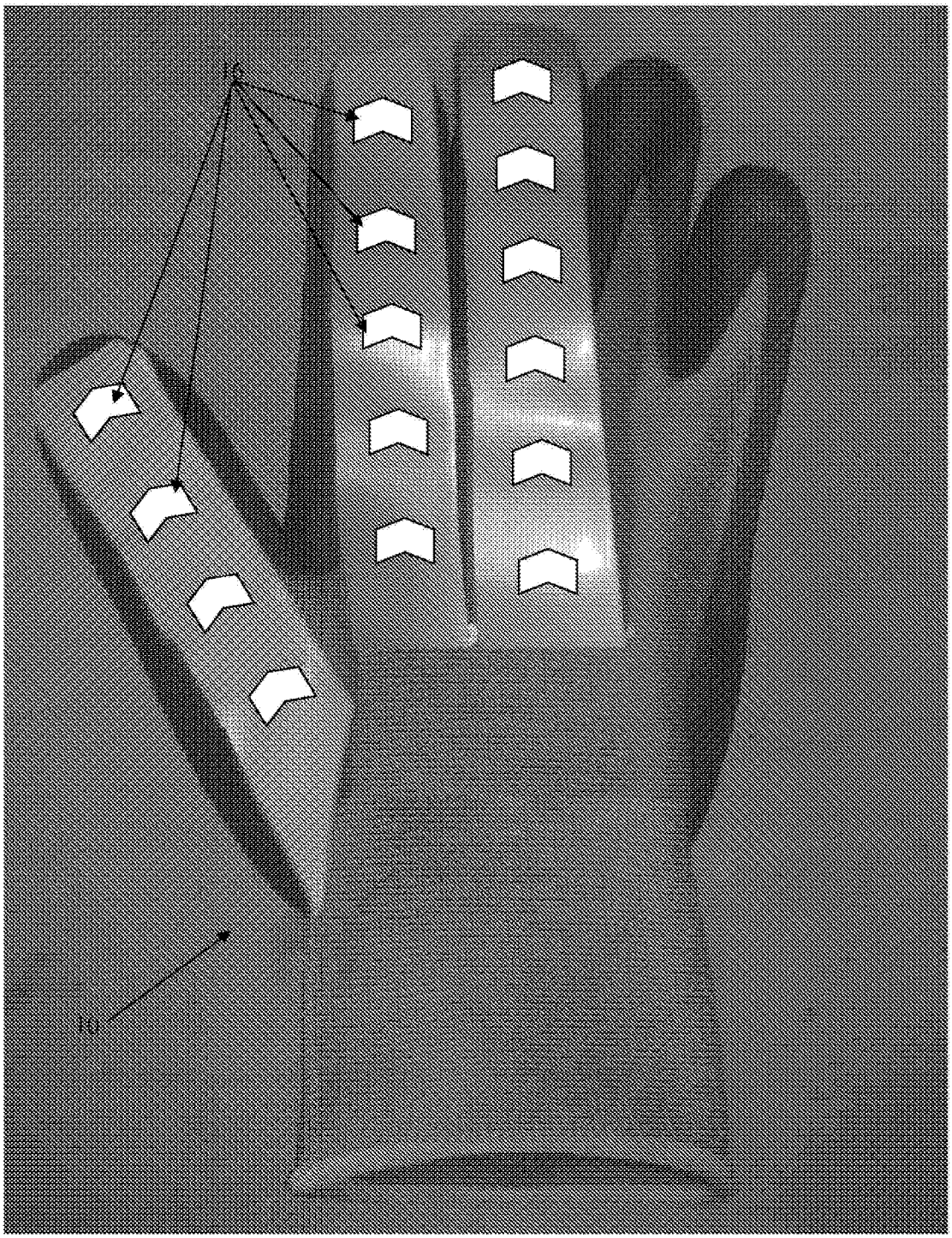
FIG. 2 is a plan view of an alternative enhanced visibility glove according to a preferred embodiment of the present invention.

According to the embodiment illustrated in FIG. 2, chevrons 16 are provided on the strips on a glove. The chevrons are oriented from the base of the strip (at the cuff end) toward the tip of the phalange portion or thumb portion. Provision of chevrons in this way can be used to indicate direction. As illustrated, different numbers of chevrons may be provided on different strips in order to allow a viewer to distinguish between the different strips.

Figures 3, 4, 5:
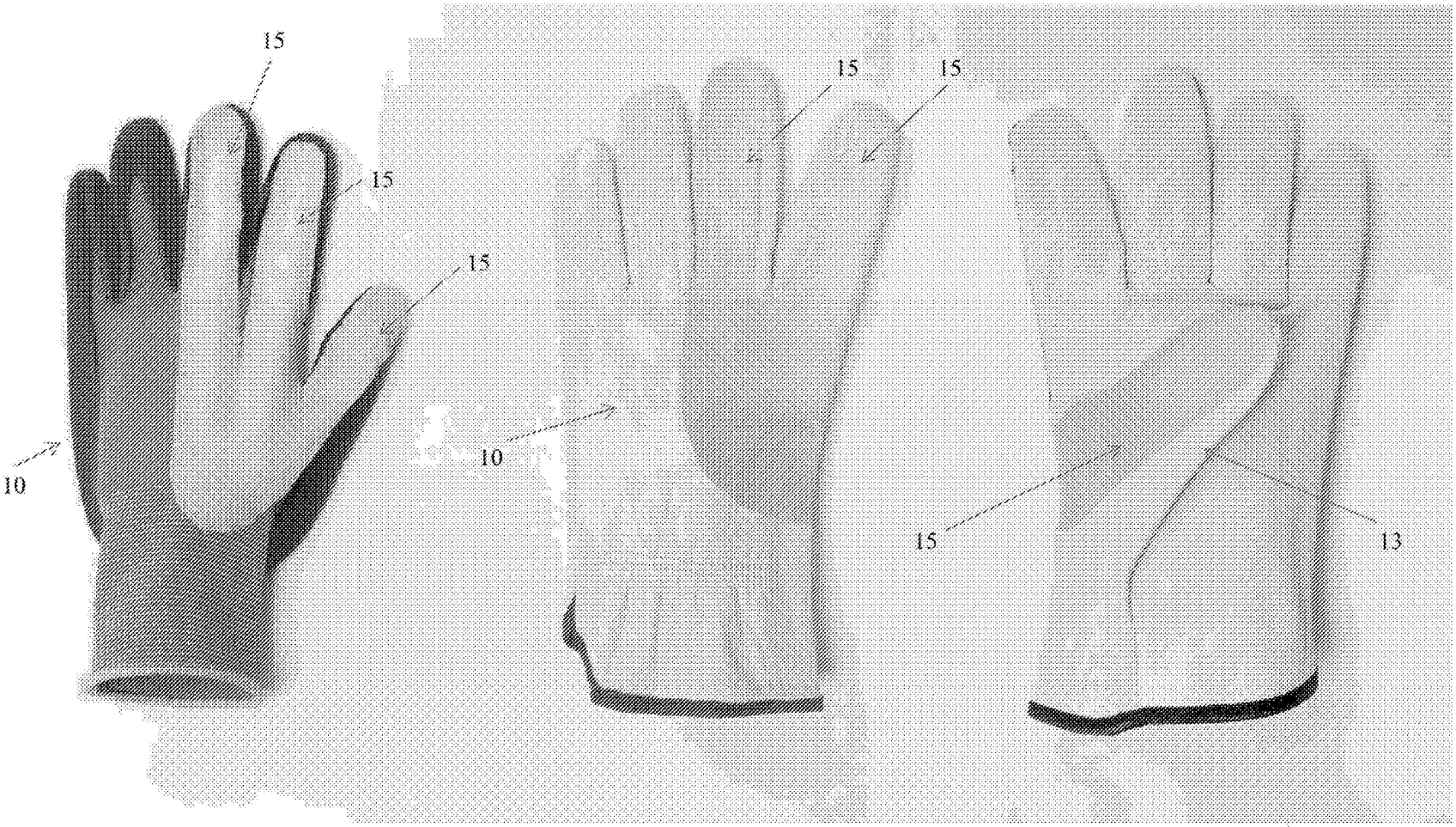
FIG. 3 is a plan view of an enhanced visibility glove according to a further preferred embodiment of the present invention.
FIG. 4 is a plan view of an enhanced visibility glove according to still a further preferred embodiment of the present invention.
FIG. 5 is a plan view of a palm side of the enhanced visibility glove illustrated in FIG. 4.

According to the embodiment illustrated in FIG. 3, a unitary enhanced visibility portion is provided having a portion which extends onto the thumb and separate portions extending on to each of the two adjacent phalange portions. As illustrated, the enhanced visibility portion extends onto the metacarpal portion of the glove.

The particular embodiment illustrated in FIGS. 4 and 5 is the most likely commercial embodiment of the present invention. Again, a unitary enhanced visibility portion is provided having a portion which extends onto the thumb and separate portions extending on to each of the two adjacent phalange portions. As illustrated, the enhanced visibility portion extends onto the metacarpal portion of the glove.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The invention claimed is:

1. An enhanced visibility glove including:

a. a cuff portion, b. a metacarpal portion extending from the cuff portion, c. a thumb portion extending from the metacarpal portion and d. at least two finger portions extending from the metacarpal portion, each having an anterior surface and a posterior surface and e. an enhanced visibility strip on the thumb portion and the at least two finger portions extending over the length of the thumb portion and the at least two finger portions on the posterior surface but not the anterior surface.

2. An enhanced visibility glove as claimed in claim 1 wherein the enhanced visibility strip provided is any one or more of reflective, luminous, phosphorescent, chemiluminescent, or photoluminescent.

3. An enhanced visibility glove as claimed in claim 1 wherein the glove includes four distinct finger portions and one thumb portion.

4. An enhanced visibility glove as claimed in claim 1 wherein a pair of finger portions is provided, one finger portion for a ring finger and little finger and one finger portion for an index finger and middle finger.

5. An enhanced visibility glove as claimed in claim 1 wherein the enhanced visibility strip extends substantially over the length of the thumb and at least one finger portions on the posterior surface thereof but not the anterior surface.

6. An enhanced visibility glove as claimed in claim 1 wherein the enhance visibility strip is provided as an adhesive strip applied to the glove, a material impregnated into material forming the glove or applied as a surface layer to the glove.

7. An enhanced visibility glove as claimed in claim 1 wherein the enhanced visibility strip on the at least two finger portions is provided on adjacent finger portions.

8. An enhanced visibility glove as claimed in claim 7 wherein the enhanced visibility strip is provided on an index finger portion and a middle finger portion of the glove.

9. An enhanced visibility glove as claimed in claim 1 wherein the enhanced visibility strip extends laterally over a portion of the posterior surface of each finger portion to which it is applied, but not over the sides of the finger portion.

10. An enhanced visibility glove as claimed in claim 1 wherein the enhanced visibility strip extends from at or adjacent the tip of the finger portion to the metacarpal portion of the glove adjacent the finger portion to which the strip is applied.

11. An enhanced visibility glove as claimed in claim 1 wherein each enhanced visibility strip is distinct and discrete over its length from other enhanced visibility strips applied to other finger portions and/or the thumb portion.

12. An enhanced visibility glove as claimed in claim 1 wherein at least one enhanced visibility strip is coloured to indicate different situations or to provide different signals.

13. An enhanced visibility glove as claimed in claim 1 wherein at least one enhanced visibility strip has a pattern applied to indicate different situations.

14. An enhanced visibility glove as claimed in claim 1 wherein words, numbers or symbols are applied to at least one enhanced visibility strip.

15. An enhanced visibility glove as claimed in claim 1 wherein one or more chevrons are provided on at least one enhanced visibility strip.

16. An enhanced visibility glove as claimed in claim 1 wherein the enhanced visibility strips is provided with a gradient of increasing or decreasing colour, reflectivity and/or luminescence.

17. A pair of enhanced visibility gloves, each enhanced visibility glove including a cuff portion, a metacarpal portion extending from the cuff portion, a thumb portion extending from the metacarpal portion and at least two finger portions extending from the metacarpal portion, each having an anterior surface and a posterior surface and an enhanced visibility strip on the thumb portion and the at least two finger portions extending over the length of the thumb portion and the at least two finger portions on the posterior surface but not the anterior surface.

18. A pair of enhanced visibility gloves as claimed in claim 16 wherein appropriate identification means is provided to allow identification of each of the gloves in the pair.

* * * * *